US006481953B1

(12) United States Patent
Michel et al.

(10) Patent No.: US 6,481,953 B1
(45) Date of Patent: Nov. 19, 2002

(54) PROCESS AND APPARATUS FOR ISOLATING FLEXIBLE FLAT OBJECTS

(75) Inventors: Bjoern Michel, Stuttgart; Rainer Buschulte, Pleidelsheim, both of (DE)

(73) Assignee: LTG Mailander GmbH, Stuttgart (DE)

( * ) Notice: Subject to any disclaimer, the term of this patent is extended or adjusted under 35 U.S.C. 154(b) by 0 days.

(21) Appl. No.: 09/548,808

(22) Filed: Apr. 14, 2000

(30) Foreign Application Priority Data

Apr. 16, 1999 (DE) ..... 199 17 405

(51) Int. Cl.[7] ..... B65G 59/00
(52) U.S. Cl. ..... 414/796; 271/91
(58) Field of Search ..... 414/796, 797, 414/796.8, 907; 271/10.01, 11, 12, 15, 18, 20, 91, 92, 93, 107

(56) References Cited

U.S. PATENT DOCUMENTS 1,789,826 A 1/1931 McCain
3,809,389 A * 5/1974 Wirz ..... 271/91
4,971,304 A * 11/1990 Lofthus ..... 271/227
6,244,586 B1 6/2001 Gauger

FOREIGN PATENT DOCUMENTS

| | | |
|---|---|---|
| DE | 1 177 652 | 4/1956 |
| DE | 2163083 | 10/1973 |
| DE | 25 02 668 | 7/1976 |
| DE | 32 10942 | 10/1983 |
| DE | 3210942 | 10/1983 |
| DE | 3039481 | 5/1986 |
| DE | 37 42637 | 6/1989 |
| DE | 3742637 | 6/1989 |
| DE | 19642484 | 4/1998 |
| DE | 197 20 568 | 11/1998 |
| GB | 698347 | 12/1951 |
| GB | 718066 | 5/1952 |

* cited by examiner

*Primary Examiner*—Kenneth W. Noland
(74) *Attorney, Agent, or Firm*—Morriss, Bateman, O'Bryant & Compagni

(57) ABSTRACT

In a process and an apparatus for isolating flexible flat objects (5) by lifting the objects (5) off a stack (1) and removing the lifted objects in a transport direction (9) it is provided that each object be aligned into a set position while being in a partially lifted state.

46 Claims, 12 Drawing Sheets

PROCESS AND APPARATUS FOR ISOLATING FLEXIBLE FLAT OBJECTS

BACKGROUND OF THE INVENTION

1. Field of the Invention

The invention relates to a process and an apparatus for isolating flexible flat objects, particularly paper sheets, cardboard sheets, metal sheets or the like, whereby the objects are lifted upwardly off a stack, and are thereby removed individually and successively in horizontal or approximately horizontal transport direction.

2. Description of Related Art

It is known in the art to lift flexible flat objects off a stack, e.g. metal sheets, by their full area using a vacuum device, and then to transport them horizontally in a transport direction to a further processing step. For precise further processing, these flat objects must be fed in an exactly defined set position so that subsequent processing steps, such as printing, stamping, etc. on the flat object take place at exactly reproducible points, which are defined, for example, with reference to one of the edges of the object.

Particularly if stacks are heavy and bulky, it may be difficult to position these stacks in relation to an isolation apparatus in a precisely reproducible manner. Moreover, any variation during lifting of the individual objects off a stack can have the result that objects that have been lifted off the stack are removed and fed to a subsequent processing unit in irregular positions with respect to each other.

DE 19642484 A1 discloses a printing machine with a rotating isolation device in which a rotary table is arranged above a sheet stack and serves to rotate the top sheet of the stack and thereby causes the second sheet to be isolated and exposed. An alignment unit, with the aid of friction forces, orients the top sheet of the stack into a set position.

To be effective, this apparatus requires that the friction forces exerted by the alignment unit on the sheet surface are greater than the adhesion forces that hold the top sheet to the stack. This requirement cannot be met for all the materials of which the flat objects to be isolated can be made.

Although it is possible in an apparatus or process for isolating flat flexible objects chronologically and/or technically to separate the steps of lifting an object from the stack and orienting this object, it would prolong the isolation process and substantially complicate and increase the required apparatus.

The goal of the invention is to define a process and an apparatus of the generic class, which will make it possible simply and quickly to align flat objects to be isolated into a set position before they are removed for further processing.

BRIEF SUMMARY OF THE INVENTION

According to a first aspect of the invention, this object is attained by a process as defined in claim 1. By integrating the operation of aligning the object into a set position with that of lifting the object off the stack, any delay due to alignment is avoided. Furthermore, alignment of the object takes place at a stage where the adhesion forces between the object and the stack are largely overcome. This eliminates the risk that the means used to align the object and engage therewith do not slide off ineffectively.

This goal is preferably attained in that the object is first lifted along one of its edges, then aligned, and finally lifted off the stack over its entire extent.

Depending on which edge of the object is to serve as reference in further processing, the position of the lifted edge or that of the opposite edge can be adjusted to a set position to align the object. To align the object, the edge serving as reference can be moved via sensors that are remote from the stack either in the direction or against the direction of transport, in order to detect the orientation of the edge and possibly to shift the edge in a controlled manner and thus to align it based on the measurement result of the sensor. Alternatively, the edge can be brought into contact with at least one stop element that defines the set position.

If the rigidity of the flexible object is low, alignment along a set position preferably comprises pulling the object in the direction of its lifted edge. Since this edge is free above and below, it can be clamped if necessary to exert a substantial pull thereon and thus reliably to overcome any residual adhesion to the stack of the object area that is still resting on the stack.

If the rigidity of the material is great enough and/or the residual adhesion to the stack of the partially lifted object is low, alignment to a set position preferably comprises pushing the object in the direction of its non-lifted edge. This movement frees the edge to be lifted of the next object to be isolated from the stack, which can then be lifted even before the previous object has been completely aligned or removed.

In addition to aligning the lifted edge or the edge opposite thereto, it is advantageous also to adjust a lateral edge of the object to a set position. This completely defines the position of an object entering a further processing unit both in the direction of transport and perpendicularly thereto.

Alignment is advantageously effected by displacing and/or rotating the lifting device, which thus simultaneously acts as an alignment device.

A lifted object is preferably removed with the initially lifted edge pointing to the rear. This makes it possible to lift the next following object in the stack by its edge even before the previously lifted object has been lifted over its entire extent or removed.

To prevent sagging of the object along the lifted edge, this edge is preferably held undulately curved about a horizontal axis as it is being lifted.

To prevent uncontrolled lateral offset of the object during lifting, it has been found to be advantageous to define a segment of the object edge to be lifted first where the lifting process is to start. This segment can be a central segment or a comer of the object. In the course of continued lifting of the edge, adjacent areas should then also be lifted until the entire edge is on a predefined level.

According to a second aspect of the invention, the goals is attained by an apparatus for isolating flexible flat objects as claimed in claim 17. The apparatus comprises a lifting device that lifts the object along one of its edges and aligns it into a set position in its partially lifted state. In this state, the edge of the object opposite the lifted edge can still rest on top of the stack. Since adhesion between the stack and the object is substantially reduced, however, the object can already be precisely aligned in this state.

A preferred embodiment provides that the transport device of the apparatus according to the invention comprises a holding device that separates the partially lifted object over its entire extent from the stack and keeps it separate, and that comprises means to drive the held object in transport direction in order to feed it possibly to a further processing unit.

The apparatus preferably comprises at least one alignment element serving as reference to define a set position of an edge of the object. This edge can be the lifted edge itself or an edge opposite thereto, depending on the requirements of the subsequent processing unit. The alignment element can be a stop element with which the edge of the object is brought into contact. As an alternative or in addition thereto, a sensor can be used to detect the position of an edge of the object and to supply a measure for the movement necessary to align the object correctly. This movement can be a translation and/or a rotation of the object about a vertical axis for which the object is preferably driven by the lifting device.

According to a preferred embodiment, the lifting device comprises a suction head arrangement or a suction box extending in the direction of the lifted edge. Such an arrangement or suction box holds the flexible object over substantially the entire length of its edge. A suction box with a straight underside thus prevents the edge from sagging.

Such a linear course of the edge facilitates a precise positioning of the object crosswise to the transport direction. However, the underside can also be curved, so that it also curves the object lying against the suction box. As a result, the object is stiffened parallel to the transport direction to facilitate its precise positioning in this direction.

According to a preferred embodiment, the apparatus comprises both the arrangement of suction heads and the suction box, with the functions of lifting the edge and aligning the object being divided between the two elements.

To prevent the top side of a completely lifted object from scratching along the suction box during subsequent removal, a preferred embodiment provides that the apparatus blow air through the suction box when a lifted object is removed, in order to keep the object at a distance from the suction box during removal.

The holding device of the apparatus according to the invention is preferably arranged above the stack such that it exerts a force of attraction in downward direction, and the lifting device lifts the edge of the object far enough so that it is caught by this force of attraction. At first, therefore, an area of the object adjacent to the lifted edge reaches the range of action of the holding device and is lifted by it. Lifting and adhesion to the holding device thus propagates from the initially lifted edge over the entire length of the object until the object is completely lifted off the stack. In this state, the object can be removed and possibly fed to a further processing unit.

A preferred embodiment of the invention provides that the lifting device hold the lifted edge of the object undulately curved about an axis parallel to the edge. Such a curve serves to stiffen the partially lifted object in the direction parallel to the edge. This curve can be produced, for example, by providing the suction heads or the suction box of the lifting device with a contact surface for the object that slopes downwardly in the direction toward the edge, or by tilting a contact surface, which is horizontally oriented when an object on the stack is pulled up by suction, about an axis parallel to the edge during lifting.

Actuators for horizontal displacement of the object held to the holding device into the alignment position preferably comprise, respectively, a housing, a shaft displaceable within the housing in one or two spatial directions, and expandable elements disposed in pairs opposite each other in an annular space between the housing and the shaft, which can be pressurized with a pressure medium to adjust the position of the shaft in relation to the housing in the spatial direction or directions.

This shaft can be hollow and in turn can form part of a suction air channel of the lifting device. In this case, the expandable elements can perform not only the function of adjusting the shaft but can also seal the suction air channel against the environment.

To achieve a high degree of mobility of the shaft in relation to the housing, the expandable elements are preferably provided with folded sidewalls to permit strong expansion or compression of the expandable elements in the direction to be adjusted.

The pressure medium pressurizing the expandable elements is preferably air.

Substantially play-free guidance of the shaft in relation to the housing in a third spatial direction is achieved with the aid of parallel flanges formed on housing and shaft and located opposite each other in pairs. To be able to displace these flanges with little friction in relation to each other under the action of the expandable elements, they are advantageously spaced at a distance from each other by rolling elements. These rolling elements can be cylindrical or, in the preferred case where the position of the shaft can be adjusted in relation to the housing in two spatial directions, spherical.

BRIEF DESCRIPTION OF THE SEVERAL VIEWS OF THE DRAWINGS

Further features and advantages of the invention will result from the following description of exemplary embodiments with reference to the attached figures. The following show.

DETAILED DESCRIPTION OF THE INVENTION

Figure 1:
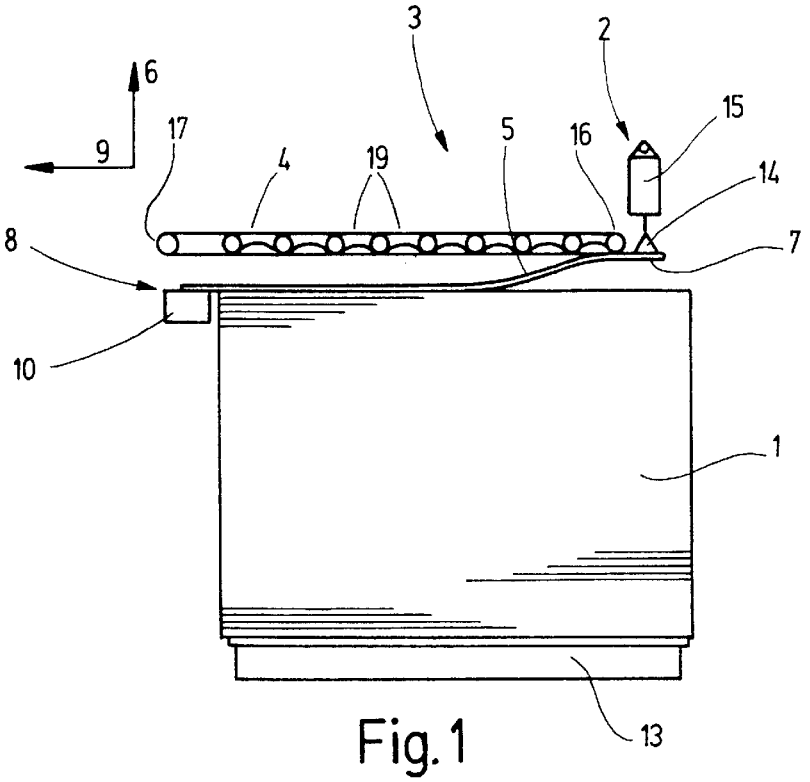
FIG. 1, a highly schematic side elevation of an apparatus according to the invention in a first phase of a process for isolating flat objects.

FIG. 1 shows a schematic side elevation of an isolation apparatus 3 by means of which flat flexible objects 5 are to be isolated from a stack 1. Objects 5 are stacked with their large areas lying on top of each other to form stack 1 on a lifting platform 13 (merely outlined here). The drawing is purely schematic and additional components such as, for example, drive and control devices, mechanical connecting and/or fastening elements, electrical and pneumatic control lines, etc. have been omitted for reasons of clarity.

Objects 5 to be isolated by means of the isolation apparatus 3 can include, for example, flat, flexible sheet-type objects such as thin sheet metal, paper or cardboard sheets, plastic plates or the like. Below, they are consistently referred to as objects.

For a uniform definition of the description of the following exemplary embodiments, a lifting direction is identified in a coordinate system by an arrow 6 and a transport direction by an arrow 9. In the following discussion, unless otherwise specified, lifting direction 6 in the drawings is assumed to be an upward movement and transport direction 9 a leftward movement. If the individual parts of the isolation apparatus to be described below are appropriately arranged, lifting direction 6 and transport direction 9 can of course be selected differently.

The isolation apparatus comprises a lifting device 2 and a holding device 4. Lifting device 2 comprises a plurality of lifting suction units 15 arranged in a line perpendicular to the drawing plane, only one of which can be seen in the figure. Each lifting suction unit has a suction foot 14 that is height adjustable, i.e., displaceable in lifting direction 6, and that is set upon an object 5 to be lifted and placed under a vacuum so that it will attach itself to the object. Lifting device 2 is arranged such that suction feet 14 engage with a trailing edge 7, as seen in transport direction 9, of objects 5 to be isolated from a stack 1. Engagement can be directly at edge 7 or at a distance thereto—as seen in transport direction 9.

Holding device 4 extends above stack 1 at a height corresponding to approximately an upper end position of suction feet 14 and has a delivery edge 17 opposite a receiving edge 16 adjacent to suction feet 14. Holding device 4 may be formed as a contact strip segment, a possible structure of which is explained in further detail by means of FIG. 15.

Figure 2:
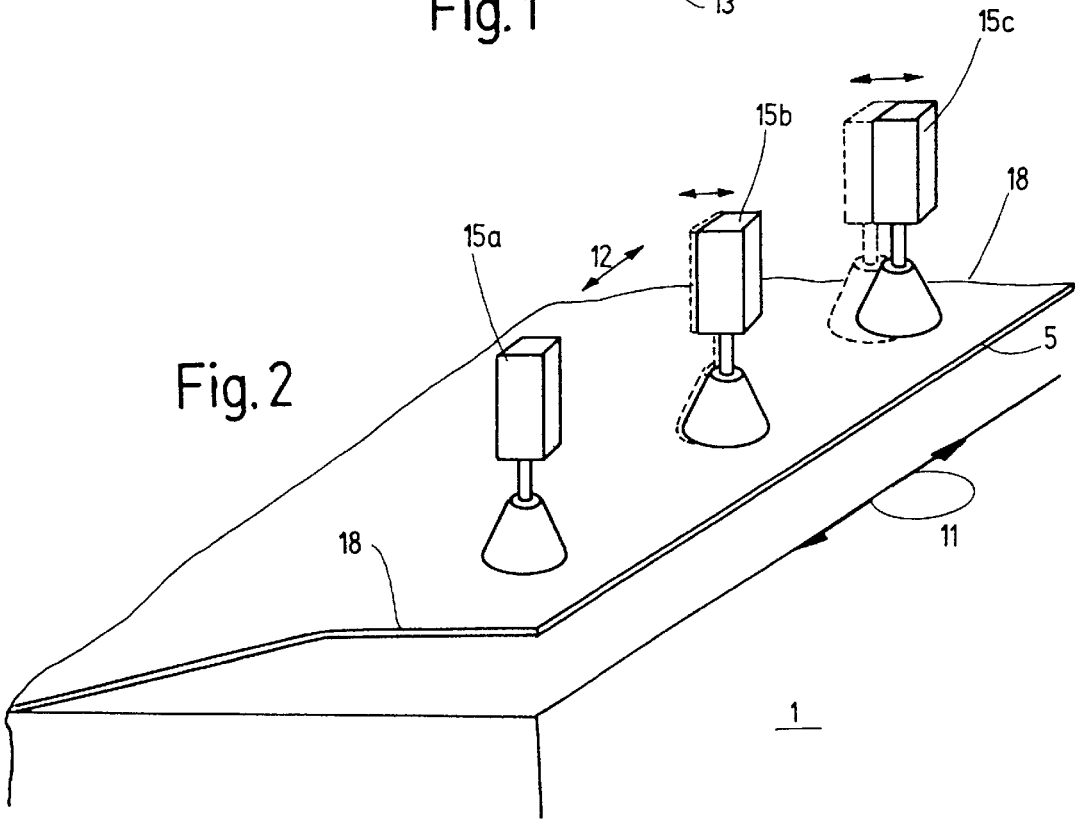
FIG. 2, a perspective view of an arrangement of lifting suction units of the apparatus depicted in FIG. 1.

The isolation device depicted in FIGS. 1 to 4 operates as follows: First, lifting suction units 15 with their suction feet 14 are set on the topmost object of stack 51 and are placed under a vacuum. This causes object 5 in the area of its trailing edge 7 to be pulled up by suction and to be lifted through a movement of suction feet 14 in lifting direction 6. The partially lifted object 5 is then displaced by moving lifting device 2 in transport direction 9 such that a leading edge 8 of the object glides past an arrangement of sensors 10 disposed to the side of stack 1 in transport direction 9. This state is shown in FIG. 1. Sensors 10 detect when they are swept by edge 8 of the sensor [sic] and supply a signal to a control device (not depicted) that controls the movement of lifting device 2 such that edge 8 of the object lies in a set position above sensors 10. FIG. 2, by way of example, shows a movement of the lifting suction units of the apparatus identified in this figure are as 15*a*, 15*b*, 15*c* during the alignment of object 5. In the case shown, this movement consists of a rotation 11 about a vertical axis defined by the lifting suction unit 15*a*. During this movement, lifting suction unit 15*a* is kept stationary while lifting suction units 15*b* and 15*c* experience a translation movement in or against transport direction 9.

In addition to sensors 10 shown in FIG. 1, sensors (not depicted) for detecting the position of a lateral edge 18 (see FIG. 2) of object 5 may be provided. Depending on the position detected by them, a correcting movement in transverse direction 12 to transport direction 9 may be executed.

Figure 3:
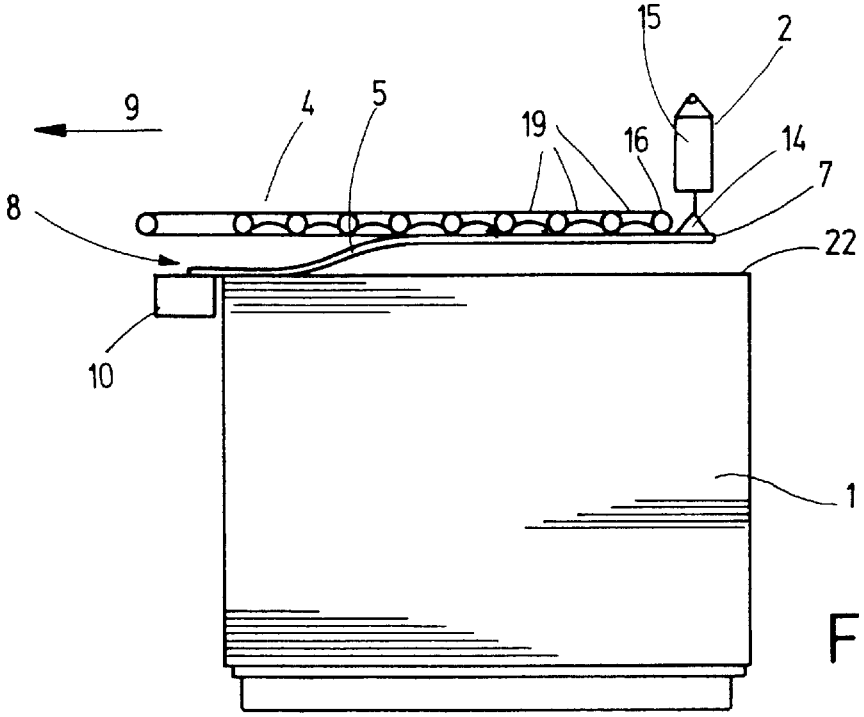
FIGS. 3 and 4, the apparatus shown in FIG. 1 in different phases of the process.
Figure 4:
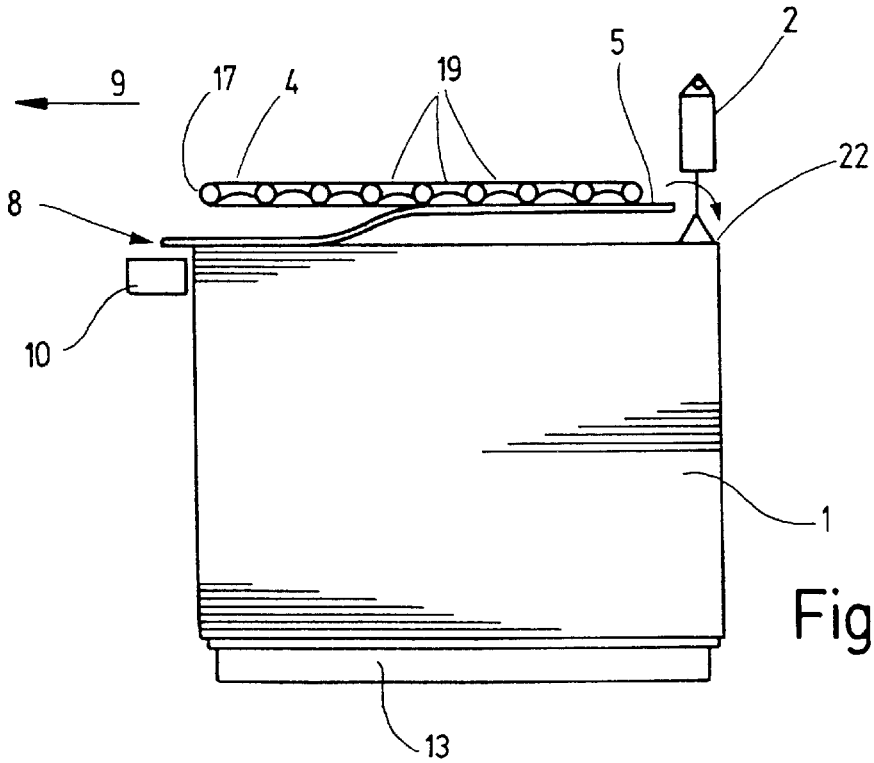

After alignment of object 5, suction heads 19 distributed over the surface of holding device 4 and embedded therein are placed under a vacuum. As a result, an area of object 5 adjacent to lifted edge 7 first comes into the range of action of the attractive force exerted by suction heads 19 near receiving edge 16. This area comes into contact with the suction heads, an adjacent area in transport direction of object 5 is caught by the suction action and lifted, such that the lifting process is propagated like a wave over the entire length of object 5 as shown in FIG. 3. As soon as object 5 contacts, and is held by, holding device 4 over a sufficient length, suction feet 14 of lifting suction units 15 can be released from object 5 and, as shown in FIG. 4, can be displaced against transport direction 9 and lowered onto the subsequent object on stack 1 in the vicinity of trailing edge 22 of the stack. No later than when object 5 completely contacts holding device 4, the latter can be driven in transport direction 9 to remove object 5 and deliver it at delivery edge 17 to a further processing or conveyor unit (not depicted) and thus to free the apparatus to receive the next object.

Corresponding to the progress of the isolation, lifting platform 13 successively raises stack 1 such that the topside of stack 1 is kept at a constant level.

Figure 5:
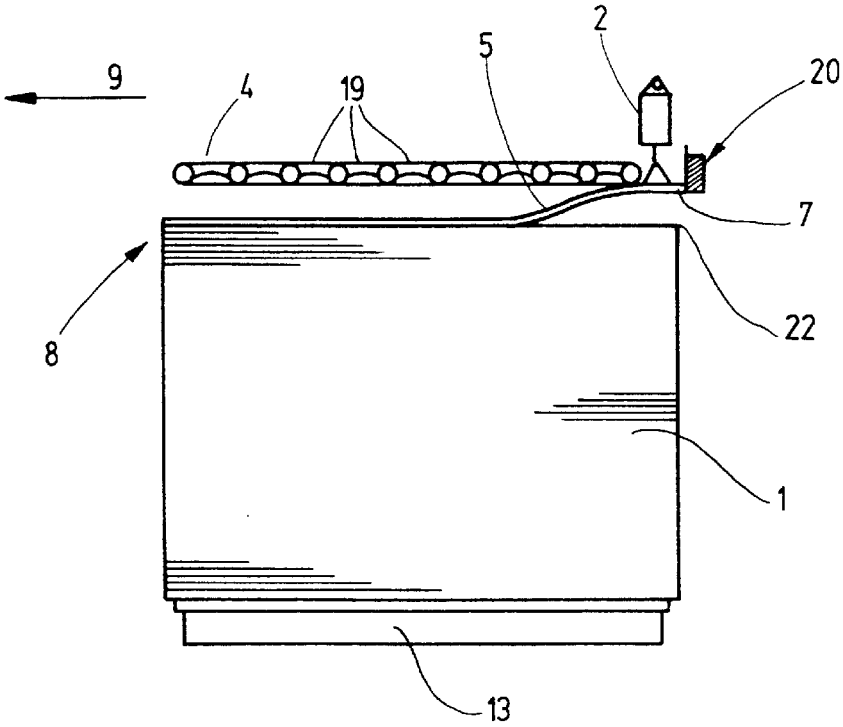
FIG. 5, a side elevation of a second embodiment of an apparatus according to the invention.

FIG. 5 shows a second embodiment of an isolation apparatus according to the invention. Like the first embodiment, this embodiment comprises a lifting device 2 with several lifting suction units 15 and a holding device 4, with which an object 5 comes into contact after alignment prior to being removed. Instead of sensors, this embodiment depicted in FIG. 5 has a plurality of stop elements 20 arranged offset beyond trailing edge 22 of stack 1 against transport direction 9. After lifting device 2 has lifted object 5 in the area of its trailing edge 7 off the stack, it is moved against transport direction 9 to bring trailing edge 7 in contact with stop elements 20 and thus to align object 5 into a set position. This procedure is particularly suitable if adhesion between the individual objects of the stack is strong or the rigidity of the objects is low, which involves the risk that during alignment by displacing the partially lifted object 5 in transport direction 9 object 5 might be compressed. A pull exerted against transport direction 9 can be substantially greater than a thrust, without there being a risk of damaging object 5.

Figure 6:
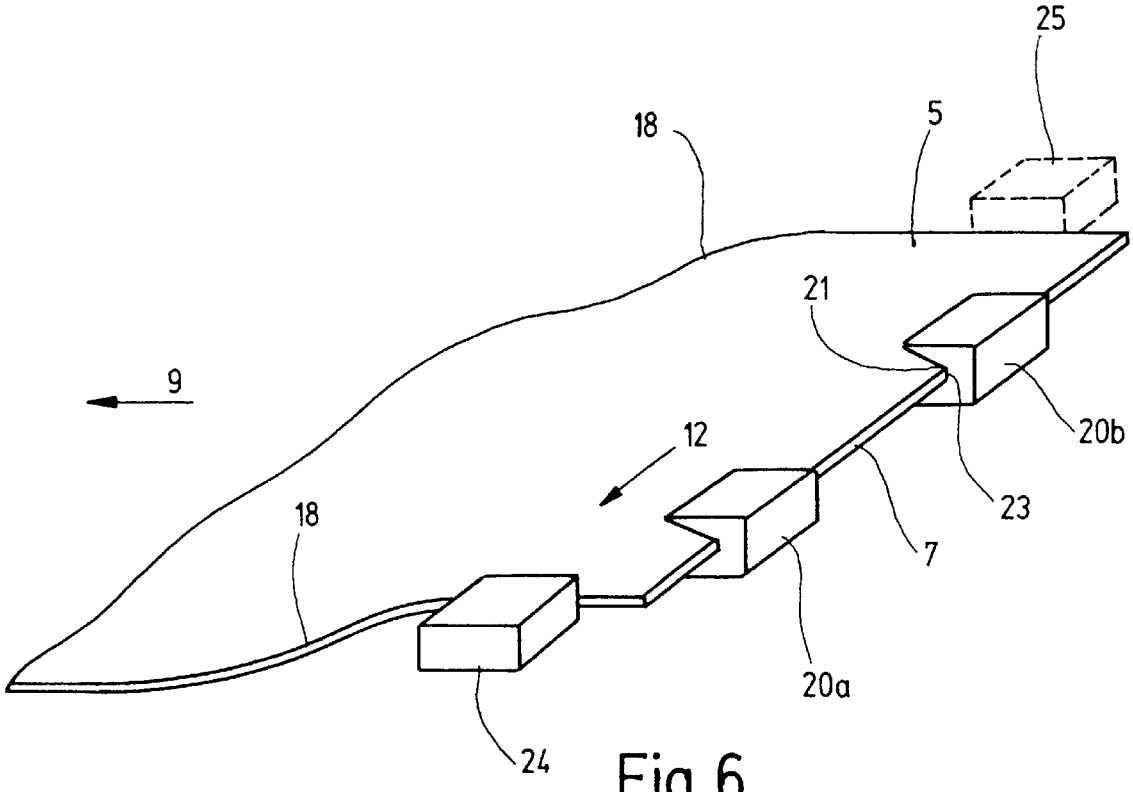
FIG. 6, stop elements of the apparatus shown in FIG. 5 with a flat object stopped against them.

FIG. 6 shows a perspective view of stop elements identified here as 20*a*, 20*b* for trailing edge 7 of object 5, as well as a stop element 24 for a lateral edge 18 of object 5. Stop elements 20*a*, 20*b* have a trapezoidal notch 21 facing trailing edge 7, which is wide open toward object 5 so that it can securely receive trailing 7, and which tapers narrowly toward the back toward a bottom 23 in order to define the set position of trailing edge 7 precisely. The lateral stop element 24 may have a corresponding cross section with a trapezoidal opening oriented in transverse direction 12, although it is not depicted in this way. Depending on which of the two lateral edges 18 of the object is to serve as a reference edge, stop element 24 may of course be replaced by a stop element 25 disposed on the opposite lateral edge 18 and indicated in the figure by a dashed line.

After object 5 has been aligned into its set position by bringing it into contact with the stop elements, suction heads 19, which in this second embodiment of the apparatus according to the invention are also distributed over the length of holding element 4, are placed under a vacuum to cause object 5 progressively to contact said holding element 4 from receiving edge 16 to delivery edge 17. No later than when object 5 is in full contact with holding device 4, the latter is driven to transport object 5 in transport direction 9.

Figure 7:
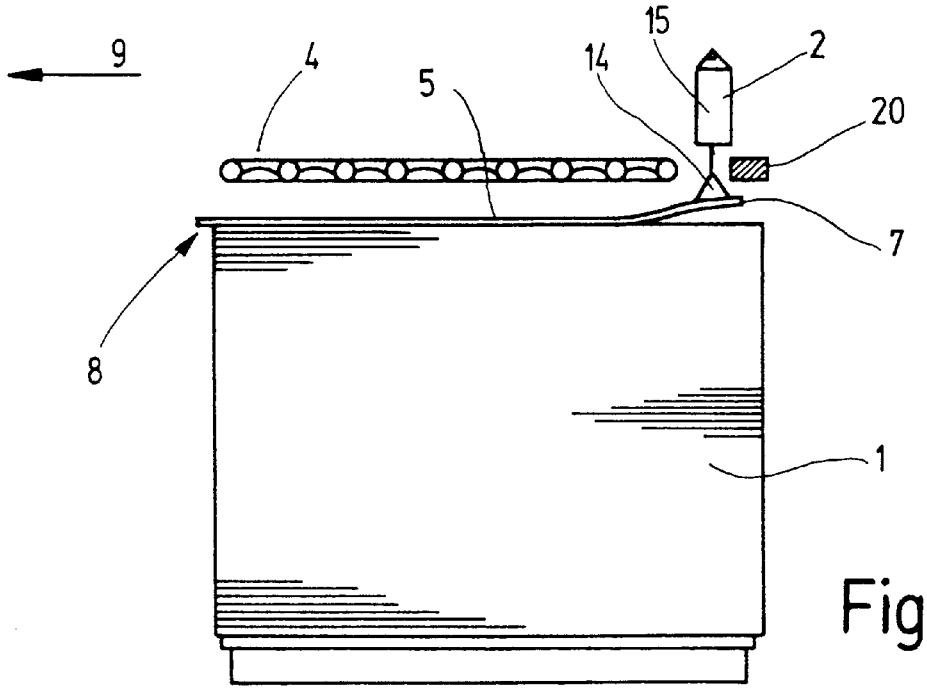
FIGS. 7, 8, 8A and 9, a variant of the apparatus depicted in FIG. 5 in different phases of a process according to the invention.
Figure 8:
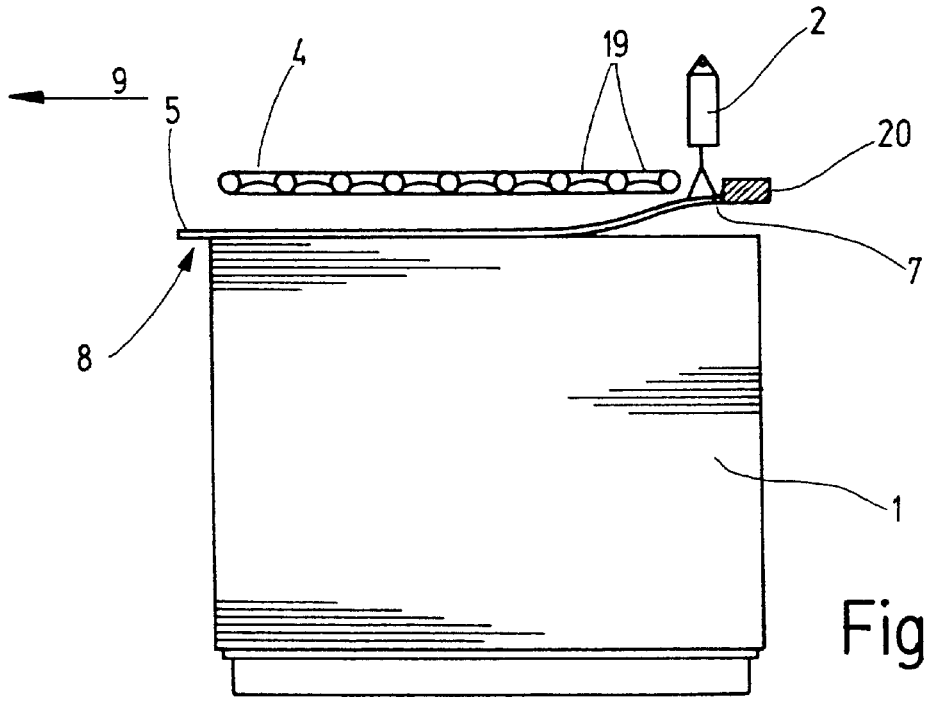
Figure 9:
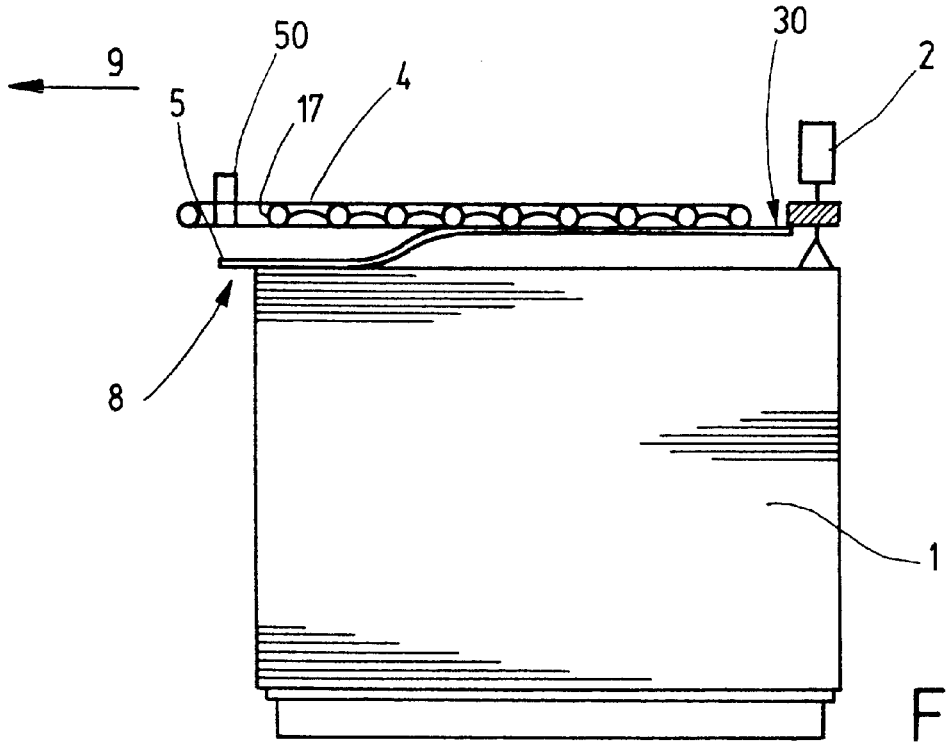
Figure 8A:
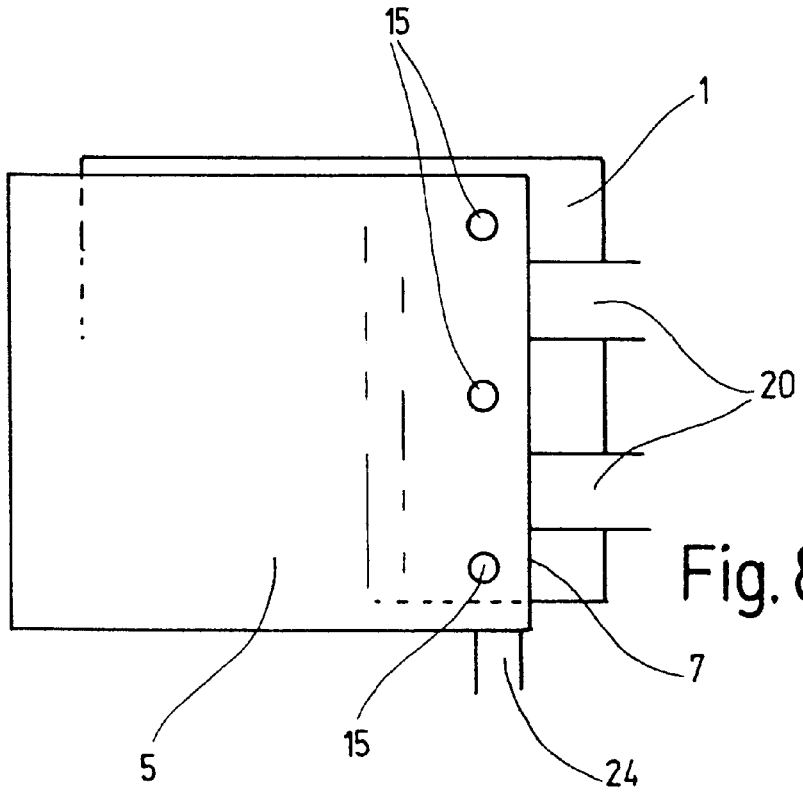

FIGS. 7 to 9 show a third embodiment of the isolation apparatus according to the invention and its mode of operation. FIG. 7 shows a stage in the operating cycle of this apparatus at which the lifting device 2 is about to lift the rear area of an object 5 off stack 1. The lifting device 2 comprises several lifting suction units 15 with suction feet 14 arranged in a row as described in connection with FIG. 1. During lifting, the lifting device 2 displaces object 5 in transport direction 9 so that in the state shown in FIG. 7 its leading edge 8 slightly protrudes over the edge of stack 1. The lifting device 2 displaces object 5 in transport direction 9 as far as necessary to be able to lift its trailing edge 7 in front of stop elements 20, which are arranged above the upper side of the stack 1. By means of a short movement against transport direction 9, lifting device 2 brings trailing edge 7 of object 5 into contact with stop elements 20 and thus aligns the object into its set position. This stage is shown in FIG. 8. FIG. 8A shows this state in a top view onto stack 1, in which the devices for holding and displacing the lifting suction units above the stack have been omitted, as in the previous figures. Lifting suction units 15 hold the partly lifted object 5 to contact stop element 20. Lifting suction units 15 and stop elements 20 are arranged so that they alternate in transverse direction 12.

After alignment of object 5 along stop elements 20 (and possibly along a lateral stop element, not depicted, like stop elements 24, 25 shown in FIG. 6), suction heads 19 of holding device 4 are placed under a vacuum and thus pull object 5 toward them. As soon as object 5 is held to holding device 4, suction feet 14 of lifting device 2 are released from the object, the lifting device is displaced against transport direction 9 so that suction feet 14 cross trailing edge 7 of object 5 between stop elements 20 or on the far side thereof, and come to rest above the free surface of stack 1. Starting from this position, suction feet 14 are lowered to pick up the next object from stack 1 even before the previously picked up object 5 has made full contact with holding device 4, as shown in FIG. 9. This makes it possible to achieve high speed in isolating objects 5.

As a variant thereto, a sensor 50 may be arranged in the area of delivery edge 17 of holding device 4 as shown in FIG. 9. This sensor measures the position of leading edge 8 of object 5 held to the holding device. As a function of the measuring result of sensor 50, acceleration of object 5 when driven in transport direction 9 is controlled such that the leading edge 8 of object 5 is fed in precisely positioned manner to a subsequent unit or machine. The sensor, when object 5 is supplied, thus makes it possible to use leading edge 8 as the reference edge for further processing in the subsequent unit, while alignment is carried out with reference to the trailing edge 7.

A further development (not shown) of the apparatus described in connection with FIGS. 5 and 6 respectively and 7 to 9 provides that the stop elements 20 can be moved in lifting direction together with lifting device 2. This feature permits an alignment of object 5 as early as when its trailing edge is lifted by means of the lifting device. When the trailing edge then reaches a height at which it is captured by the attractive force exerted by holding element 4, the object is already completely aligned into its set position. On the one hand this feature accelerates the isolation process and on the other hand permits a simplification of this process. For since the alignment can occur even before the object comes into the range of action of the suction heads of the holding device, their action no longer needs to be timed precisely and they can be operated without interruption if desired.

Figure 10:
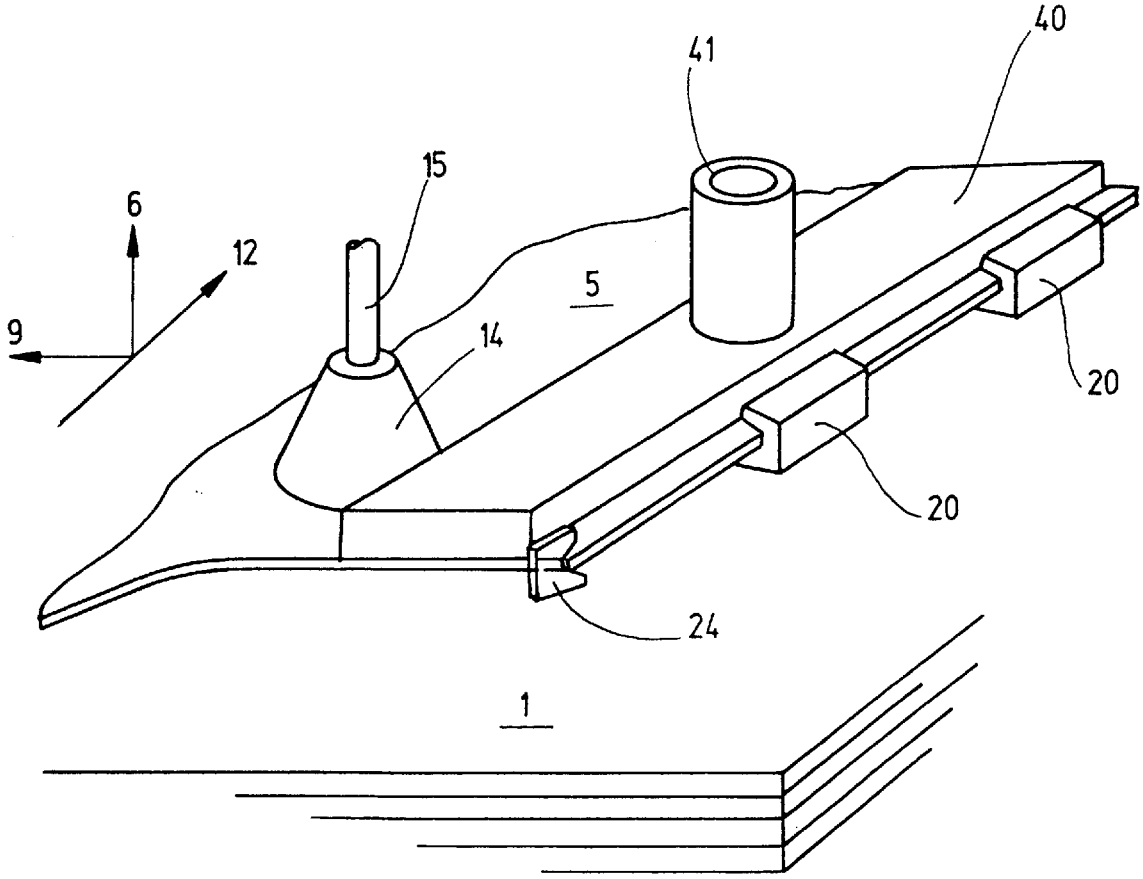
FIG. 10, a partial view of an apparatus according to the invention with a suction box.
Figure 11:
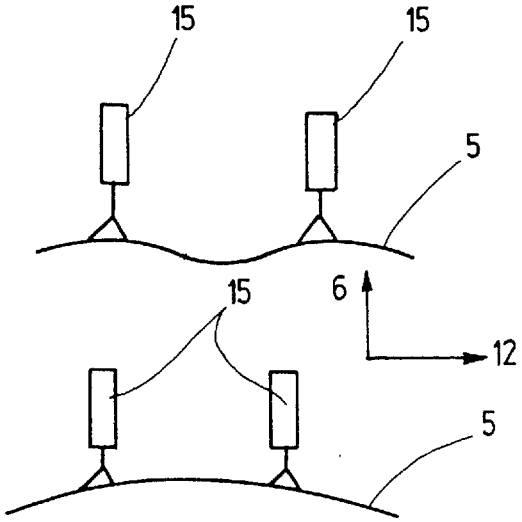
FIG. 11, views of an arrangement of suction lifting devices and an object lifted in transport direction showing possible errors in the position of the lifted object.

According to a further variant of the invention, the individual suction feet 14 of the several lifting suction units may be replaced by a suction box 40 depicted schematically in a perspective view shown in FIG. 10. This suction box 40 extending over substantially the entire width of object 5 is a hollow box open toward the bottom and connected via a shaft 41 with an individual lifting suction unit (not depicted) and can be lifted via the latter, adjusted in transport direction 9 and transverse direction 12, as well as rotated about an axis parallel to lifting direction 6. This suction box 40 has the advantage that it lifts object 5 over its entire width to a uniform height and reliably prevents any undulate or arched sagging of object 5 in transverse direction 12, which can easily occur with objects that have little inherent rigidity, as shown in FIG. 11, if the number of lifting suction units 15 arranged across the width of object 5 is insufficient. Thus suction box 40 facilitates alignment of object 5 and enhances its accuracy.

In this variant, the holding device pulls the object up by suction in the same manner as described above. To prevent the surface of the object from being scratched by the suction box as the object is removed by the holding device, the invention provides that air be blown through suction box 40 during removal, so as to prevent contact between suction box and object.

A further development of the embodiment provides that the lifting device comprises a suction box 40 in combination with an arrangement of lifting suction units 15, of which FIG. 10 shows only one in part. This variant makes it possible to divide the functions of lifting trailing edge 7 of object 5 and aligning the object. The lifting suction unit arrangement with suction feet 14 can thus be used to pick up an object 5 from stack 1 up to the height of suction box 40. As soon as this height is reached, suction box 40 captures object 5 (this stage is shown in FIG. 10) and aligns it by bringing the precisely guided trailing edge 7 of object 5 in contact with stop elements 20, 24. In this case, it is sufficient if the suction box is displaceable only in transport direction and transverse direction as well as rotatable.

Figure 12:
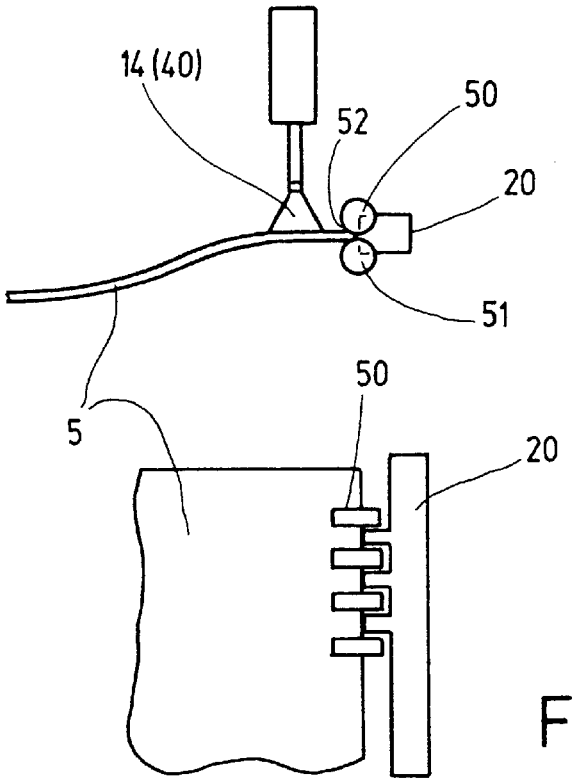
FIG. 12, a partial view of an apparatus according to the invention depicting a further developed variant of a stop element.

FIG. 12 shows a side view and top view of a modification of a stop element 20 in an isolation apparatus according to the invention. Stop element 20 depicted in FIG. 12 is provided with rollers 50 and 51 above and below the level at which object 5 meets the stop element. Said rollers 50 and 51 catch an object 5 guided to stop element 20 even if its height deviates from the desired stop height at stop element 20, which is defined by a gap 52 between rollers 50 and 51, which guide object 5 toward this gap 52. As shown in the top view a plurality of rollers 50 and 51 are arranged along a common axis and tooth-like projections 21 of stop element 20 extend into interstices between the individual rollers 50. Rollers 50, 51 can be free-running rollers that are brought into rotation by object 5 contacting them. If strong adhesion forces must be overcome when object 5 is lifted from the stack, they can also be provided with a drive of their own to pull object 5 into gap 52.

This variant of the stop element can be used with both a lifting device with individual lifting suction units 15 provided with suction feet 14 and in connection with a suction box 40.

Figure 13:
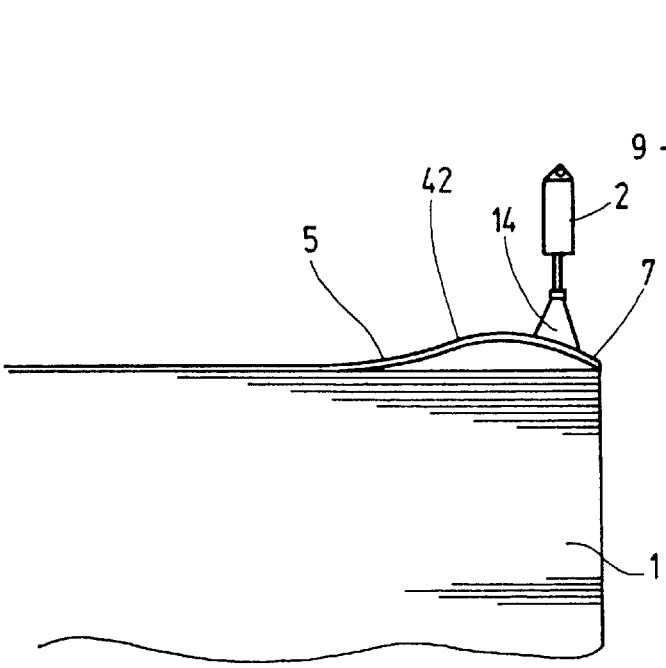
FIGS. 13 and 14, lifting devices to lift the object with an undulate curvature.
Figure 14:
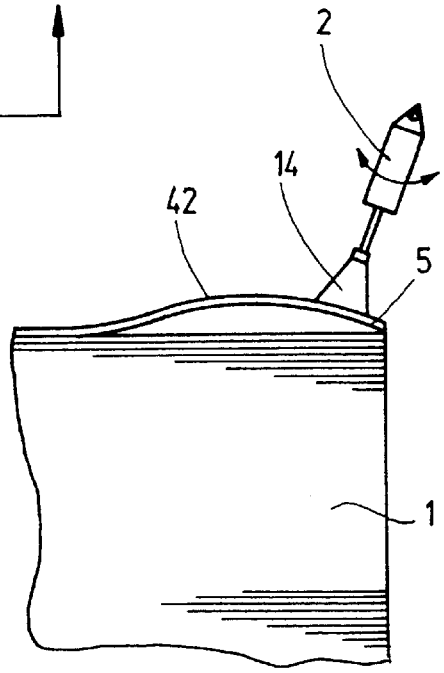

FIGS. 13 and 14 show two modifications of a lifting device that may be used in combination with any of the embodiments described above. In the variant shown in FIG. 13, suction feet 14 of lifting device 2 form oblique contact surfaces along their underside for object 5 to be lifted off stack 1. These contact surfaces slope downwardly toward trailing edge 7 of the object. Since suction foot 14 is made of a flexible material such as rubber, it can tightly contact object 5 by a mere downward movement in lifting direction 6 and can be placed under a vacuum. When a suction foot 14 thus designed has attached itself to the surface and the lifting device begins to lift it, object 5 forms an undulately curved segment 42 during lifting whose axis of curvature extends substantially parallel to edge 7. This curvature significantly increases the flexural rigidity of object 5 in transverse direction so that deformations as shown in FIG. 11 cannot occur. The same effect can be achieved by using a suction box 40 with correspondingly sloping contact surfaces instead of suction feet 14.

The variant shown in FIG. 14 uses suction feet 14 (or a suction box) with a horizontal contact surface as shown, for instance, in FIGS. 1 and 5 and in FIG. 10. In this embodiment, however, suction foot 14 (or a suction box) is not only lifted in lifting direction 6 to lift object 5, but lifting device 2 swings about an axis parallel to the transverse direction so that the contact surface of object 5 assumes an oblique orientation on suction foot 14. This again creates an undulately curved segment 42 in object 5 with the same effect as that described in connection with FIG. 13.

From this position, object 5, now stabilized by this camber, can be lifted and aligned.

Figure 15:
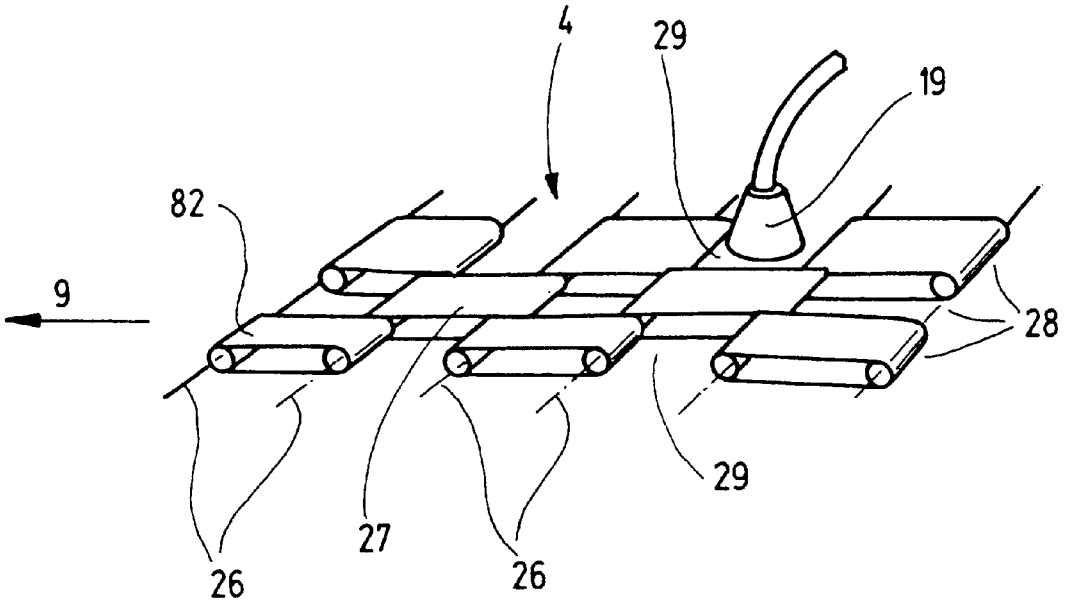
FIG. 15, a perspective view of a holding device of an apparatus according to the invention.

FIG. 15 schematically shows a perspective view of a holding device 4 of an isolation apparatus according to the invention. The holding device 4 comprises an arrangement of a plurality of parallel shafts 26 indicated in the figure by a dashed line representing their axes, around which strip elements 27 are looped. These strip elements are arranged in transport direction 9 in rows 28, in which each strip element 27 encircles two adjacent shafts 26. Between each set of two strip elements, there is an opening 29. In one of these openings 29, a suction head 19 is shown, which is connected to a vacuum source via a pipe. Such suction heads are arranged in openings 29 in the required number to produce the needed force of attraction.

As soon as an object 5 has been lifted over its entire extent and adheres to the underside of holding device 4, shafts 26 are brought into rotation, possibly while the vacuum on suction head 19 is reduced, in order to set object 5 into motion in transport direction 9.

Figure 16:
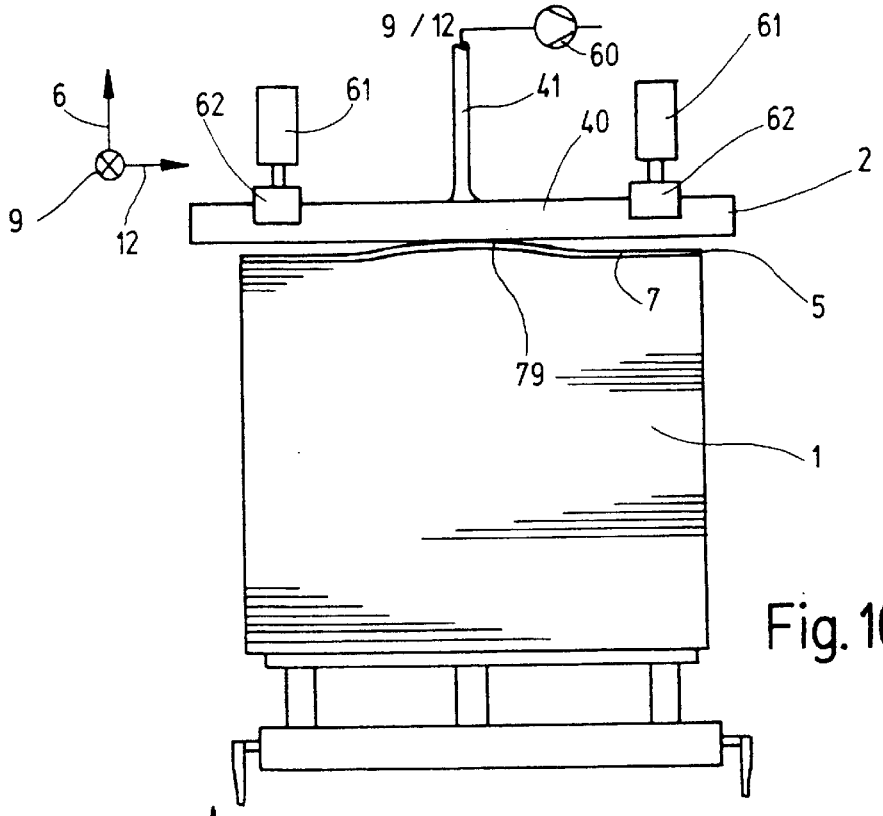
FIG. 16, an end view of a second apparatus according to the invention in a first phase of a process for isolating flat objects.

FIG. 16 shows an end view of a further embodiment of an isolation apparatus according to the invention. Transport direction 9 extends along the depth of the drawing. A lifting device to lift the topmost object 5 off stack 1 comprises a suction box 40 extending over the width of the stack. A pump 60 supplies the suction box with a vacuum via a central shaft 41. As a result, the suction force of box 40 is strongest in the center and object 5 is lifted first in the center 79 of its trailing edge 7 in transport direction. This state is shown in the figure. The suction pressure along the edge areas of suction box 40 is lower, but sufficient to bring edge 7 along its entire length into contact with suction box 40 once it has been lifted at the center.

Control cylinders 61 serve to lift or lower suction box 40. They are connected with the suction box via horizontal actuators 62, which serve to adjust the object to the stop elements in transport direction 9 and transverse direction 12, e.g. stop element 20 depicted in FIG. 17. The structure of these actuators 62 will be explained in further detail with reference to FIGS. 19 and 20.

Figure 17:
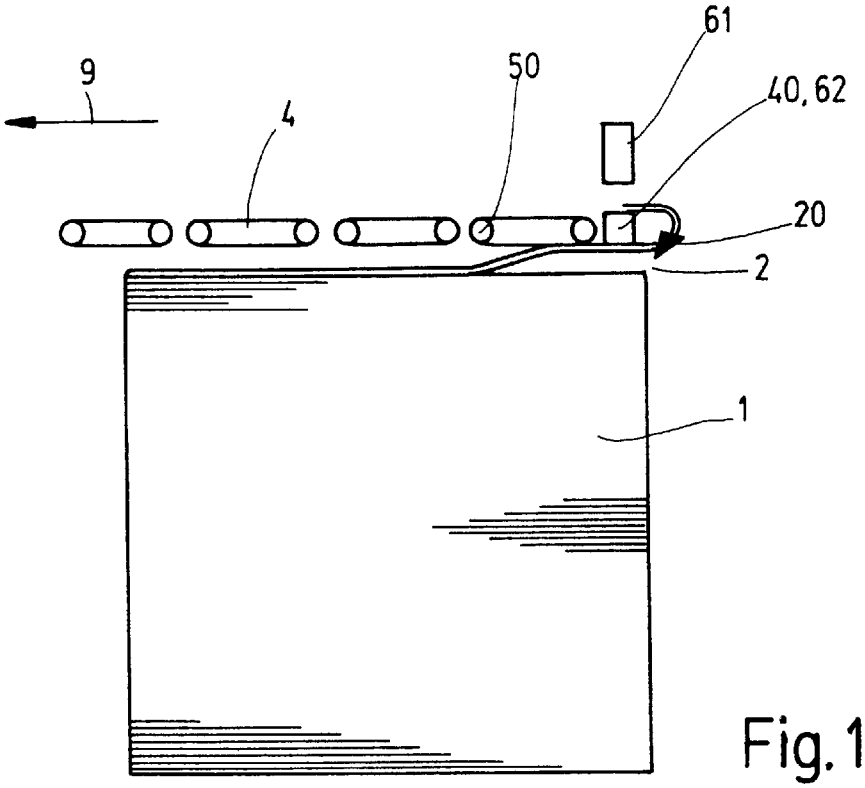
FIGS. 17, 18, side elevations of the apparatus depicted in FIG. 16 in other phases of the process.
Figure 18:
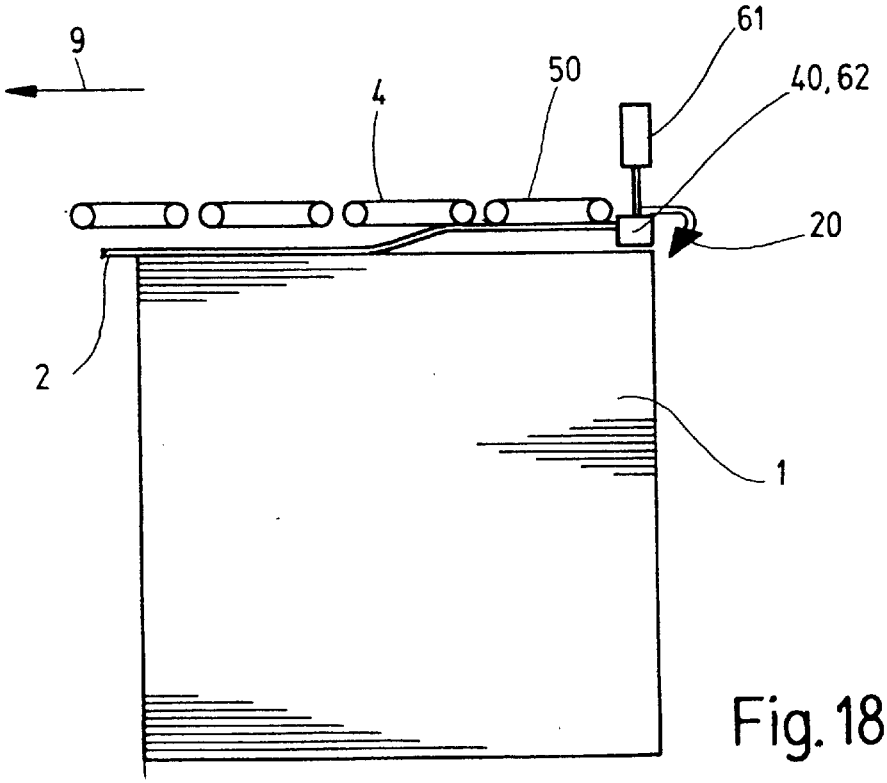

FIG. 17 shows a side view of the apparatus depicted in FIG. 16 in a later phase of the isolation process analogous to the phase shown in FIG. 5. Object 5 is lifted from stack 1 along the entire length of its edge 7 and touches stop element 20. As a vacuum is supplied to holding device 4 as described above, object 5 progressively contacts the holding device and can be transported in transport direction 9. As soon as the adhesion of object 5 to holding device 4 is sufficiently strong, rollers 50 of the latter can be brought into rotation to remove object 5. As shown in FIG. 18, suction box 40 can thus again be moved downwardly to stack 1 and can start to lift the next object even before the previously lifted object has completely left the stack.

Horizontal actuators 62 in FIGS. 17 and 18 are not depicted separately from suction box 40. Stop element 20 can be moved in lifting direction together with suction box 40 so that it is always located at the height of the underside of the suction box, and a lifted object 5 can be brought into contact with it irrespective of the distance of its edge 7 from the topside of stack 1.

Figure 19:
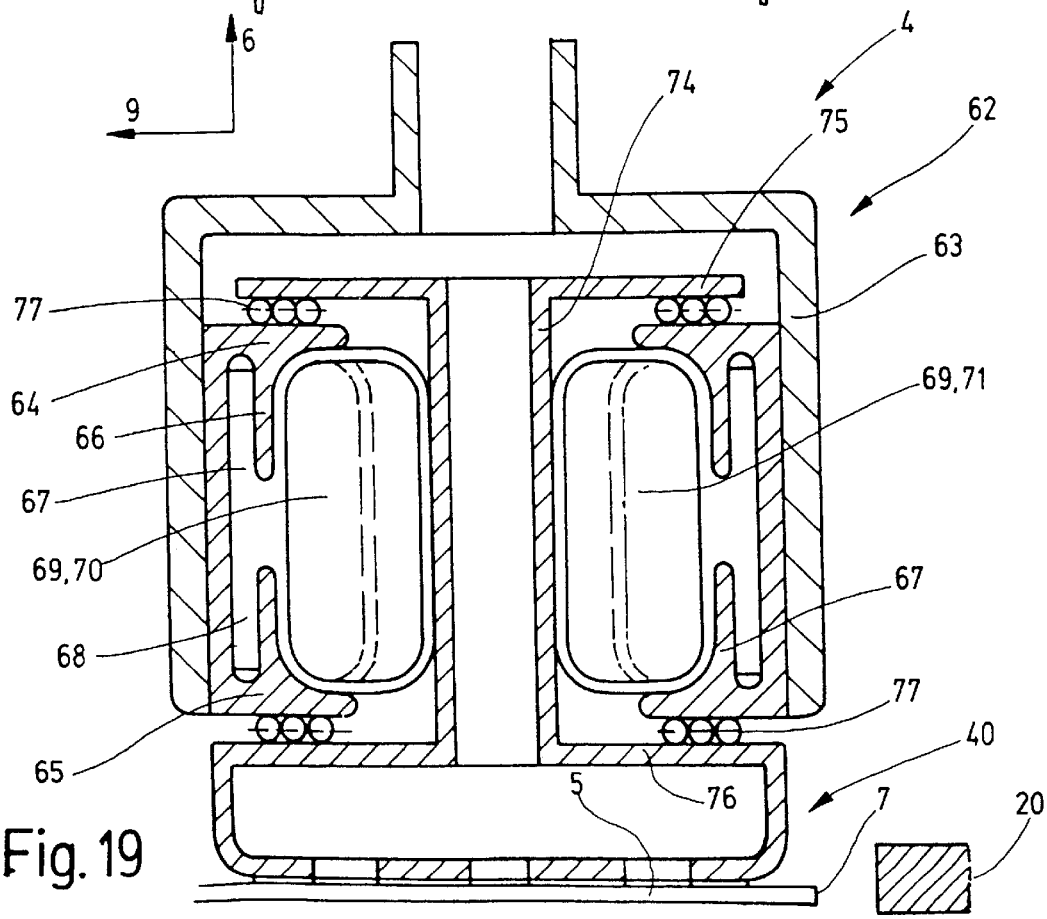
FIGS. 19 and 20, sections through actuators of the apparatus depicted in FIG. 16 in a plane parallel to the lifting direction.
Figure 21:
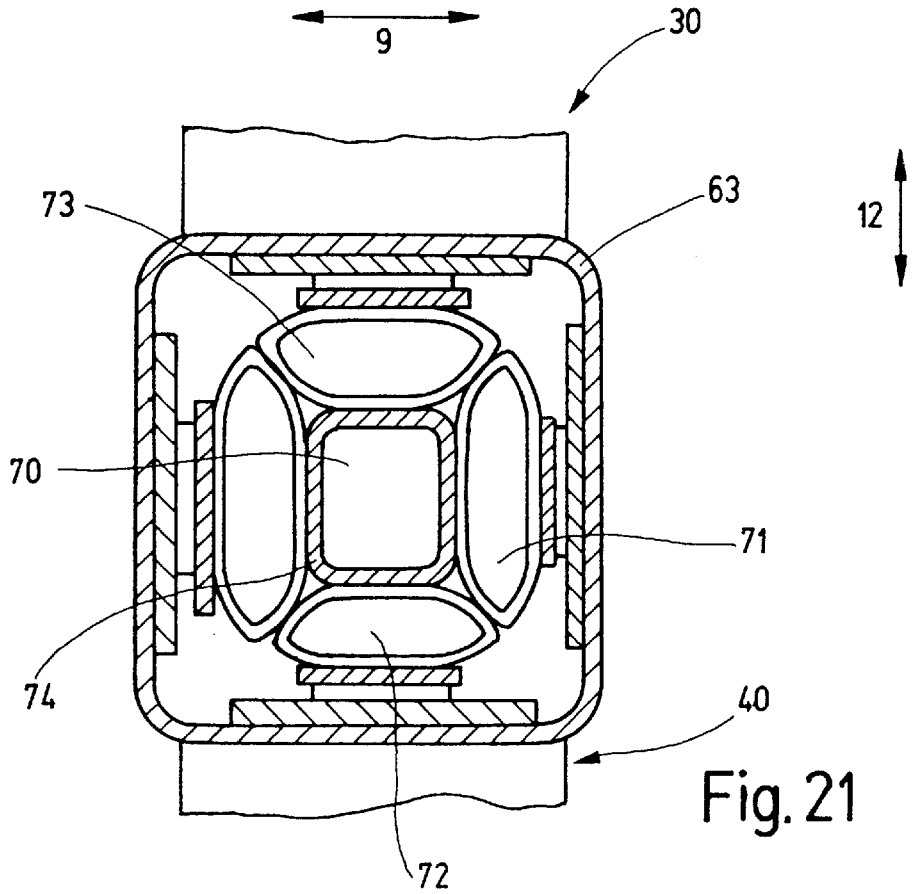
FIGS. 21 and 22, sections through embodiments of actuators in a plane perpendicular to the lifting direction.
Figure 22:
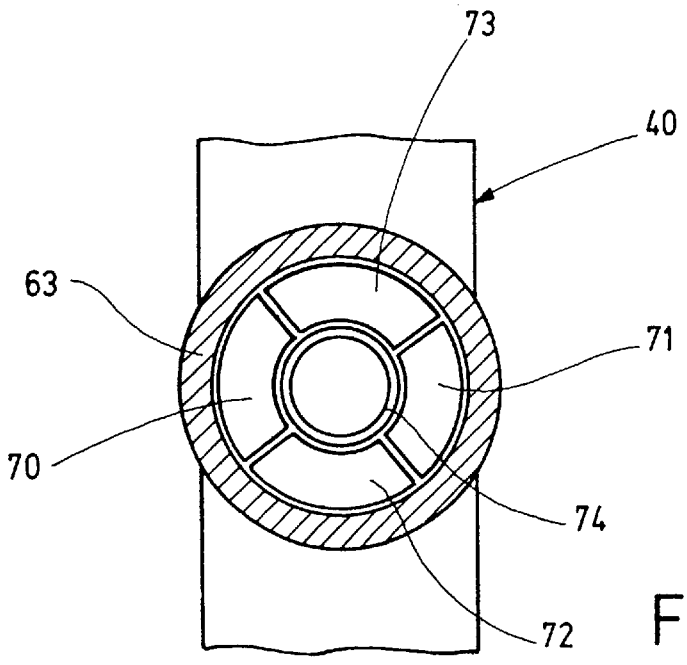

FIG. 19 shows the structure of an actuator 62 according to a first variant. This actuator comprises a housing 63, which, as shown in the cross sections depicted in FIGS. 21 and 22, can for instance be rectangular or round. Two flanges 64, 65 project radially inwardly from the inner wall of the housing. Two axial flange extensions 66 facing each other define an annular space open toward the interior of the housing into which anchoring feet 68 of an arrangement of expandable elements 69 reach. The expandable elements 69 are annularly arranged around a shaft 74 and enclose hollow spaces 70, 71, 72, 73, which are located opposite each other in pairs and which can be connected with an overpressure source independently from each other. The overpressure source can be, for example, the output side of pump 60.

Shaft 74 at its ends carries two flanges 75, 76 that are aligned parallel to flanges 64, 65 of housing 63 and perpendicularly to lifting direction 6. Between flanges 64, 75 respectively 65, 76, balls 77 are arranged, which ensure that the flanges can be displaced with respect to each other with a minimum of friction.

By an appropriate adjustment of the pressures in air chambers 70 to 73, shaft 74 can thus be arbitrarily positioned in transport direction and transverse direction to bring an object 5 held by suction box 40 into contact with stop element 20.

In the exemplary embodiment described here, flange 76 is also the upper side of suction box 40. This permits a compact design of holding element 4 in lifting direction.

In the isolation apparatus shown in FIG. 16, the shafts of actuators 62 may be solid. For a good vacuum supply of the suction system, however, it may be useful to run suction channels directly through actuators 62. For this purpose, shaft 74 is hollow so that a vacuum can be applied to suction box 40 via shaft 74. Advantageously, the internal pressure of expandable elements 69 is thus great enough to ensure a complete seal between the expandable elements and shaft 74 along the entire circumference of the shaft.

Figure 20:
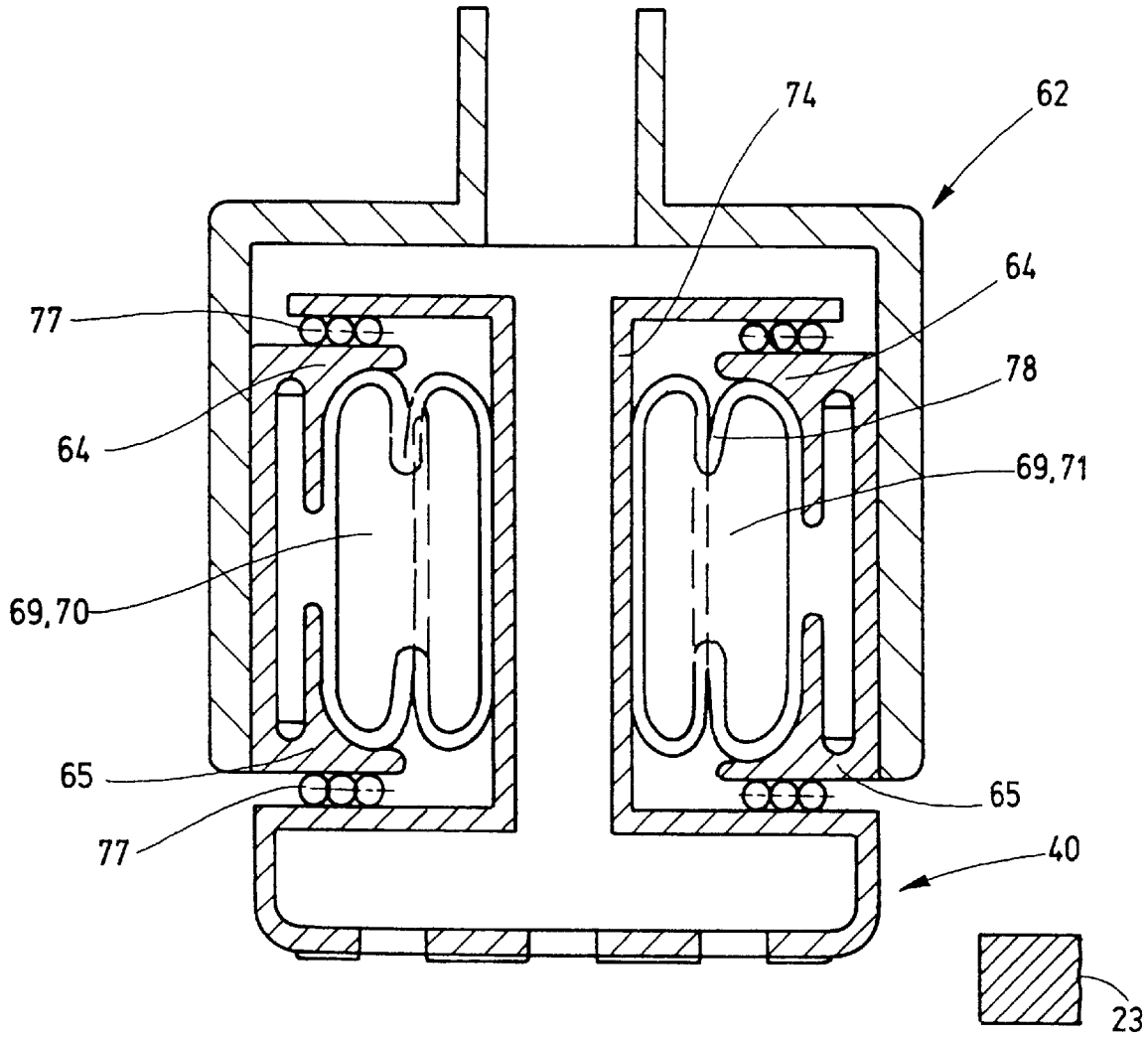

The modification of actuator 62 shown in FIG. 20 is distinguished from that of FIG. 19 in the design of expandable elements 69. In FIG. 20, expandable elements 69, along their sides facing flanges 64, 65, each have folds 78 that permit air chambers 70, 71, 72, 73 to be selectively expanded or compressed without the strip material per se having to be elastically stretched for this purpose. The walls of expandable elements 69 thus exert hardly any elastic forces on shaft 74, which facilitates precise control of the shaft's position. This variant, too, can of course have the cross sections that are shown by way of example in FIGS. 21, 22.

What is claimed is:

1. A process for isolating flexible, flat objects from a stack, comprising:

providing a stack of objects, each object having at least two edges;

providing a lifting device positioned to engage an object on top of said stack;

lifting a portion of an object from atop said stack by lifting said object along a first edge thereof;

aligning said object into a set position while partially lifted;

lifting said object along its full extent; and removing said object from said stack in a defined transport direction.

2. The process as claimed in claim 1 wherein said lifted first edge is adjusted to a set position for alignment.

3. process as claimed in claim 2 wherein said first edge is brought into contact with at least one stop element.

4. The process as claimed in claim 2 wherein a second edge positioned opposite said lifted first edge is aligned responsive to sensors detecting the position of said second edge.

5. The process as claimed in claim 2 wherein said object is aligned to a set position by adjustment of a second edge positioned opposite said first edge.

6. The process as claimed in claim 3 wherein said second edge is aligned responsive to sensors detecting the position of said second edge.

7. The process as claimed in claim 1 wherein said partially lifted object is further aligned into the set position by moving said object in the direction of said lifted first edge.

8. The process as claimed in claim 2 wherein said alignment into a set position comprises moving said lifted object in the direction opposite said first edge.

9. The process as claimed in claim 1 wherein said object further comprises at least one lateral edge positioned laterally to said first edge and wherein the position of said at least one lateral edge of said object is additionally adjusted to a set position.

10. The process as claimed in claim 1 wherein said alignment is effected by displacing and/or rotating said lifting device engaging said lifted object.

11. The process as claimed in claim 1 wherein said object is transported with said first lifted edge oriented in a direction opposite to the defined transport direction.

12. The process as claimed in claim 1 wherein as said object is lifted from said stack, said lifting device lifts an edge of a subsequent object in said stack.

13. The process as claimed in claim 1 wherein as said lifted portion of said lifted object is being lifted, a segment adjacent said portion is held undulately curved.

14. The process as claimed in claim 1 wherein said first edge is first lifted starting at a first segment of said first edge, and is subsequently lifted in segments adjacent to said first segment.

15. The process as claimed in claim 14 wherein said first segment is located in the center of said first edge.

16. The process as claimed in claim 14 wherein said first segment is a corner of said lifted object.

17. Apparatus for isolating and removing flexible flat objects from a stack comprising, a lifting device positioned for lifting an edge of an object from said stack and aligning said object while in a partially lifted state to a set position, and a transport device to remove said lifted objects in a defined transport direction.

18. The apparatus as claimed in claim 17 wherein said transport device further comprises a holding device that separates said object along its entire extent from the stack and keeps it separate, and means for moving said held object in a transport direction.

19. The apparatus as claimed in claim 18 wherein said lifting device is selectively positionable to lift the edge of an object on the stack, while said holding device separates an object previously lifted by said lifting device from the stack and moves it.

20. The apparatus as claimed in claim 17 further comprising at least one alignment element positioned to define a set position of a lifted edge of an object partially lifted from said stack.

21. The apparatus as claimed in claim 20 wherein said at least one alignment element is positioned to define a set position of a trailing edge of a partially lifted object.

22. The apparatus as claimed in claim 20 wherein said alignment element is selectively movable together with said lifting device in a defined lifting direction.

23. The apparatus as claimed in claim 20 wherein said alignment element is a stop element.

24. The apparatus as claimed in claim 23 wherein said stop element is provided with at least one pair of rollers to grip an object and guide the object into contact with said stop element.

25. The apparatus as claimed in claim 20 wherein said alignment element is a sensor positioned to detect the position of an edge of a partially lifted object from a stack.

26. The apparatus as claimed in claim 17 wherein said lifting device is rotatable about a vertical axis.

27. The apparatus as claimed in claim 17 wherein said lifting device is selectively movable back and forth relative to and in the direction of said defined transport direction.

28. The apparatus as claimed in claim 17 wherein said lifting device is positioned to lift an object from a stack first along a central segment of e of the object.

29. The apparatus as claimed in claim 17 wherein said lifting device is positioned to lift an object from a stack first at a corner of the object.

30. The apparatus as claimed in claim 28 wherein said lifting device further comprises a shaft through which vacuum pressure is applied. said shaft being positioned to engage said central segment of said edge to be lifted.

31. The apparatus as claimed in claim 17 wherein said lifting device further comprises a suction device positioned to extend along the length of an edge of an object to be lifted from a stack.

32. The apparatus as claimed in claim 31 wherein said suction device further comprises a plurality of suction heads positioned to lift an edge of an object and a suction box positioned to align the object.

33. The apparatus as claimed in claim 32 wherein said suction box is structured to blow air during the movement of a lifted object from the stack.

34. The apparatus as claimed in claim 18 wherein said holding device is selectively positioned relative to a stack of objects such that it exerts an attractive force upon an object in the stack and wherein said lifting device is positioned in proximity to the area of an edge of an object so that the object is captured by the attractive force.

35. The apparatus as claimed in claim 17 wherein said lifting device is selectively positionable to hold a segment of an edge of an object to maintain said object undulately curved.

36. The apparatus as claimed in claim 17 wherein said lifting device further comprises at least one actuator to horizontally displace an object held by said lifting device into an alignment position, further comprises a housing, a hollow shaft displaceable within said housing in at least one spatial direction and, in an annular space between said housing and said hollow shaft, expandable elements arranged in pairs opposite each other, which can be pressurized with a pressure medium to adjust the position of said hollow shaft in relation to said housing in one or more spatial directions.

37. The apparatus as claimed in claim 36 said hollow shaft forms part of a suction air channel of said lifting device.

38. The apparatus as claimed in claim 37 wherein said expandable elements are positioned to seal said suction air channel against the environment.

39. The apparatus as claimed in claim 36 wherein said expandable elements have folded sidewalls.

40. The apparatus as claimed in claim 36 wherein said pressure medium is air.

41. The apparatus as claimed in claim 36 wherein said housing and said hollow shaft each carry two opposite flanges parallel to said at least one spatial direction, which fix said housing and said hollow shaft in an additional spatial direction with respect to each other.

42.The apparatus as claimed in claim 41 wherein said flanges arranged in pairs opposite each other are spaced at a distance from each other by rolling elements.

43. The apparatus of claim 20 wherein said alignment element is positioned to defined a set position of a leading edge of a partially lifted object.

44. The apparatus as claimed in claim 29 wherein said lifting device further comprises a shaft through which vacuum pressure is applied, said shaft being positioned to engage said corner of said edge to be lifted.

45. The apparatus of claim 31 wherein said suction device is a plurality of suction heads.

46. The apparatus of claim 31 wherein said suction device is a suction box.

* * * * *